US010035672B2

(12) United States Patent
Deocon Mir et al.

(10) Patent No.: US 10,035,672 B2
(45) Date of Patent: Jul. 31, 2018

(54) PRINTING DEVICE

(71) Applicants: Hewlett-Packard Development Company, L.P., Houston, TX (US); Javier Deocon Mir, Sant Cugat del Valles (ES); Daniel Gonzalez Perello, Terrassa (ES); Carlos Ciuraneta Sanchez, Terrassa (ES)

(72) Inventors: Javier Deocon Mir, Sant Cugat del Valles (ES); Daniel Gonzalez Perello, Terrassa (ES); Carlos Ciuraneta Sanchez, Terrassa (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/316,400

(22) PCT Filed: Jun. 5, 2014

(86) PCT No.: PCT/EP2014/061754

§ 371 (c)(1),
(2) Date: Dec. 6, 2016

(87) PCT Pub. No.: WO2015/185147

PCT Pub. Date: Dec. 10, 2015

(65) Prior Publication Data

US 2017/0152121 A1 Jun. 1, 2017

(51) Int. Cl.

| | |
|---|---|
| ***B65H 5/36*** | (2006.01) |
| ***B65H 29/60*** | (2006.01) |
| ***B65H 29/58*** | (2006.01) |

(52) U.S. Cl.
CPC ..... *B65H 5/36* (2013.01); *B65H 29/58* (2013.01); *B65H 29/60* (2013.01);
(Continued)

(58) Field of Classification Search
CPC ..... B65H 9/004; B65H 9/006; B65H 9/008; B65H 2404/63; B65H 2404/632;
(Continued)

(56) References Cited

U.S. PATENT DOCUMENTS 5,772,197 A 6/1998 Aoki et al.
6,055,409 A * 4/2000 Richards ..... B65H 9/006 271/251

(Continued)

FOREIGN PATENT DOCUMENTS

JP H06191686 7/1994

*Primary Examiner* — Jeremy R Severson
(74) *Attorney, Agent, or Firm* — HP Inc. Patent Department

(57) ABSTRACT

A printing device is described in which there is a media guide that is arranged to guide a printable media substrate from an upstream media path towards an input of the printing device or away from an output of the printing device towards a downstream media path. The media guide is movable between a first position and a second position. In the first position the media guide is arranged to guide the printable media along a respective media path. In the second position, which is spaced apart from the first position, the media guide forms a buffer region into which a variable amount of media substrate can collect.

15 Claims, 5 Drawing Sheets

(52) U.S. Cl.
CPC ..... *B65H 2402/10* (2013.01); *B65H 2404/63* (2013.01); *B65H 2404/632* (2013.01); *B65H 2404/693* (2013.01); *B65H 2404/7414* (2013.01)

(58) Field of Classification Search
CPC ..... B65H 2404/633; B65H 2404/7414; B65H 2404/693; B65H 29/58; B65H 29/60; B65H 2511/112; B65H 31/10; B65H 5/36; B65H 2402/10; B65H 2402/11
USPC ..... 271/3.03
See application file for complete search history.

(56) References Cited

U.S. PATENT DOCUMENTS

| | | | | |
|---|---|---|---|---|
| 6,102,393 | A | 8/2000 | Kida et al. | |
| 6,663,099 | B2 * | 12/2003 | Inoue | B65H 5/38 271/162 |
| 6,974,128 | B2 * | 12/2005 | Quesnel | B65H 5/36 271/188 |
| 6,986,511 | B2 | 1/2006 | Yamada et al. | |
| 7,021,620 | B2 | 4/2006 | Kakigi | |
| 7,050,730 | B2 | 5/2006 | Sasai | |
| 7,802,782 | B2 | 9/2010 | Moriyama et al. | |
| 8,121,530 | B2 | 2/2012 | Takiguchi et al. | |
| 8,998,193 | B2 * | 4/2015 | Barrer | B65H 29/242 271/3.01 |
| 9,688,500 | B2 * | 6/2017 | Nunn | B65H 31/26 |
| 2006/0093410 | A1 | 5/2006 | Hata | |
| 2012/0065885 | A1 | 3/2012 | Imazeki et al. | |
| 2014/0159303 | A1 * | 6/2014 | Suzuki | G03G 15/234 271/225 |

* cited by examiner

PRINTING DEVICE

CROSS-REFERENCE TO RELATED APPLICATION

This application is a U.S. National Stage Application of and claims priority to International Patent Application No. PCT/EP2014/061754, filed on Jun. 5, 2014, and entitled "PRINTING DEVICE, METHOD OF OPERATING A PRINTING DEVICE, AND A PRINTING SYSTEM," which is hereby incorporated by reference in its entirety.

BACKGROUND

Many printing devices include internal accessories or can be configured to connect with external accessories. A substrate may be fed from the printing device to an accessory device, or the substrate may be received by the printing device from an accessory device. For example, a printing device may form an image on a substrate and then feed the substrate to an accessory device for stacking, binding, stapling or any other finishing operation. Pre-printing operations, such as priming of the substrate may be performed prior to the substrate being received by the printing device.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1A:
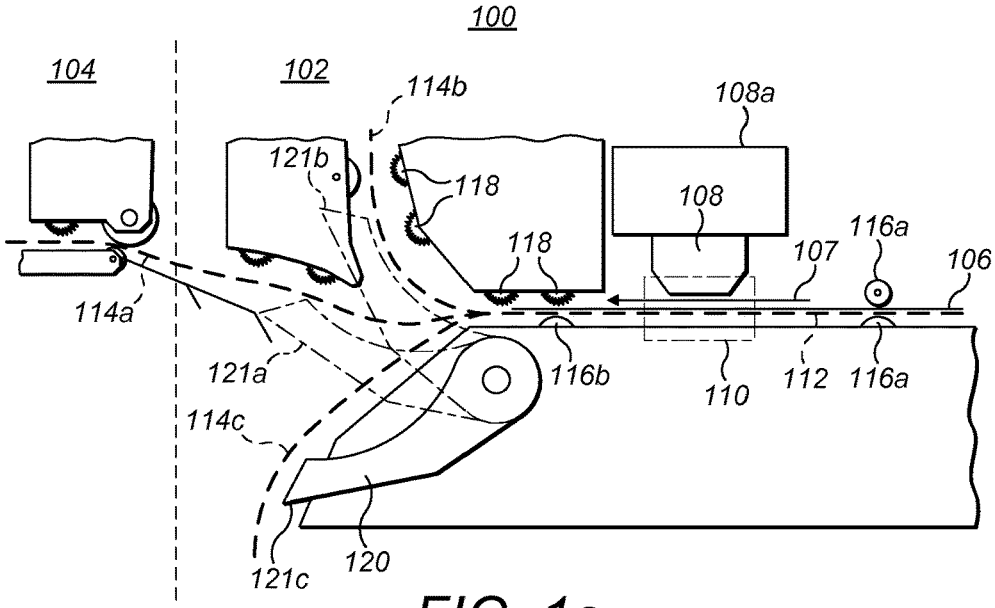
FIG. 1*a* is a schematic diagram of a printing device and an accessory device according to an example.
Figure 1B:
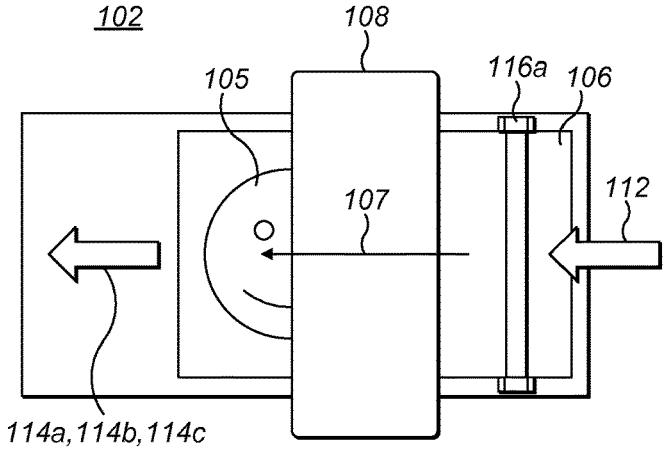
FIG. 1*b* is a schematic diagram of the printing device of FIG. 1*a*, viewed from above during a printing operation.

FIGS. 1*a* and 1*b* schematically illustrate the components of a printing system 100, which is an exemplary system used to illustrate the features of the present application. FIGS. 1*a* and 1*b*, as well as other figures referenced herein, are schematic diagrams and as such certain components have been omitted to facilitate a description of the example. Actual implementations may vary in practice.

The printing system 100 includes a printing device (referred to hereinafter as a printer) 102 and an external accessory device 104. The printer 102 is arranged to print a desired image 105 onto a printable media substrate 106 (referred to herein as the substrate), as the substrate 106 is transported through the printer 102 in a downstream direction 107.

The accessory device 104 may be a downstream accessory device as shown in FIG. 1*a*. Such a downstream accessory device may perform one or more functions after the printer 102 has printed to the substrate 106. For example, the accessory device 104 may perform functions including one or more of: coating, varnishing, foil stamping, texturing, lamination, cutting, creasing, folding, gluing, stacking, binding, stapling, splicing, rewinding, or any other suitable function. The accessory device 104 may be a multifunction finisher arranged to do more than one of these functions.

In this example, the printer 102 is an inkjet printer. The printer 102 includes one or more printing elements. Each printing element may include one or more print bars or one or more print heads.

In the example shown in FIGS. 1*a* and 1*b*, the printer 102 uses a print bar 108 which laterally extends across a printable width of the substrate 106, to print a desired image 105 onto the substrate 106. This is shown more clearly in FIG. 1*b*. This type of printer 102 is sometimes referred to as a 'page-wide' array printer. In the illustrative example, the printer 102 includes a single print bar 108. However, it will be understood that the example could equally be applied to a plurality of static print bars or one or more moveably-mounted print bars and/or print heads. The print bar 108 comprises a plurality of nozzles that are arranged to eject liquid ink onto the substrate 106.

The desired image 105 is communicated to the printer 102 in digital form. The desired image 105 may include any combination of text, graphics and images. In certain implementations, each printing element may have a print element controller 108*a* that receives data from an image processing unit (not shown). Ink is ejected from each nozzle using a transducer. The transducer may be, for example, a nozzle resister or a piezoelectric element. The data received by the print element controller 108*a* is used to activate such transducers and to control how ink is ejected from the nozzles of the printing elements.

Any suitable form of substrate 106 may be used, including, amongst others, single media sheets and/or continuous rolls; however, for ease of explanation reference will be made to a single sheet of substrate 106 in the examples. The substrate 106 may be formed of any suitable material such as, amongst others, plain paper, glossy paper, coated paper, transparencies, polymers, metal foils etc.

In the example, the substrate 106 enters the printer 102 from an upstream media path 112 shown on the right hand side of the printer 102 in FIGS. 1*a* and 1*b*. The substrate 106 is then transported through a print zone 110 i.e. along a print path underneath the print bar 108 where the print bar 108 applies ink to form the print image 105 on the substrate 106. Following the formation of the desired image 105 on the substrate 106, the substrate 106 exits the printer 102 along a downstream media path 114*a*, 114*b*, 114*c*, shown on the left in FIGS. 1*a* and 1*b*.

In the illustrative example, the printer 102 includes three downstream media paths 114*a*, 114*b*, 114*c*. Each downstream media path 114*a*, 114*b*, 114*c* is arranged to direct the substrate 106 to a different destination and may include one or more rollers, star wheels, drums and/or belts, in order to do this. As shown in the example of FIG. 1*a*, a first downstream media path 114*a* leads to the external accessory device 104, a second downstream media path 114*b* leads to an internal accessory, and a third downstream media path 114*c* leads to a waste bin.

The substrate 106 is driven in a downstream process direction by media transport which may comprise any suitable transport technology. For example, the media transport may include one or more rollers, star wheels, drums and/or belts.

In the example shown in FIGS. 1*a* and 1*b*, the printer 102 includes feed rollers 116*a* located upstream of the print zone 110. Downstream of the print zone 110, the printer 102 includes output rollers 116*b*. The printer 102 also includes star wheels 118 located on ceiling surfaces above the substrate 106 within the printer 102. The star wheels 118 are thin metal gears that only touch the paper with sharp points, so they can roll over wet areas without leaving ink tracks. The printer 102 may be operated in a continuous printing mode, in which ink is applied to the substrate 106 while the substrate 106 is continuously moving under the print bar 108. The high rate of ink application when operating the printer 102 in a continuous printing mode means that ink applied in the print zone 110 may still be wet when it leaves the print zone 110 and enters one of the downstream media paths 114*a*, 114*b*, 114*c*. This may cause curling of the substrate 106 because damp paper loses stiffness. The starwheels 118 enable a leading edge of the substrate 106 to be transferred to the downstream media paths 114*a*, 114*b*, 114*c*, while avoiding smearing the applied ink.

The printer 102 has, downstream of the print zone 110, a movable media guide 120. The media guide 120 is in the form of a motorized flap that can be selectively positioned to guide approaching substrate 106 towards one of the downstream media paths 114*a*, 114*b*, 114*c*. In the example shown in FIG. 1*a*, the media guide 120 can be positioned in three positions, a first position 121*a* to direct the substrate 106 to external accessory device 104, a second position 121*b* to direct the substrate 106 to an internal accessory (not shown), and a third position 121*c* to direct the substrate 106 to a waste bin (not shown).

Vibrations and/or jams can occur when transferring the substrate 106 to one of the downstream media paths 114*a*, 114*b*, 114*c* if the transfer is not smooth. For example, when transferring the substrate 106 from the printer 102 to the accessory device 104, vibrations and/or jams can be caused by speed disparities between the printer 102 and the accessory device 104. Such speed disparities can create a push or pull on the substrate 106. This can happen, for example, when the accessory device 104 is downstream of the printer 102 and a leading edge of the substrate 106 is in the accessory device 104 while the printer 102 is still printing on another part of the substrate 106. This is particularly problematic in printers 102 that are capable of operating in a continuous printing mode, in which an image is applied to the substrate while the substrate is moving. This is because vibrations at the interface between the printer 102 and the accessory device 104 can be transmitted to a portion of the substrate 106 that is being printed. This can in turn cause misplacement of the substrate 106 and a drop in print quality.

To prevent vibrations and jams, the relative rate at which the substrate 106 is advanced by the printer 102 and the accessory device 104 must be controlled in order that the substrate 106 is not placed under too much tension or does not gather and jam.

In order to make control of the relative feed rates of printers and their accessories more stable, a buffer devices may be used. The buffer device may be arranged to store a variable amount of substrate that can be increased when a receiving device advances the substrate 106 at a lower rate than a feeding device and decreased when the receiving device advances the substrate 106 at a higher rate than the feeding device. The substrate 106 may, for example, be stored in the buffer device as a loop of substrate.

In accordance with examples described herein, there is provided a printing device comprising a media guide arranged to guide a printable media substrate from an upstream media path towards an input of the printing device or away from an output of the printing device towards a downstream media path, the media guide being movable between a first position, arranged to guide the printable media substrate along a respective media path and a second position that is spaced apart from the first position to form a buffer region into which a variable amount of media substrate can collect.

Figure 2:
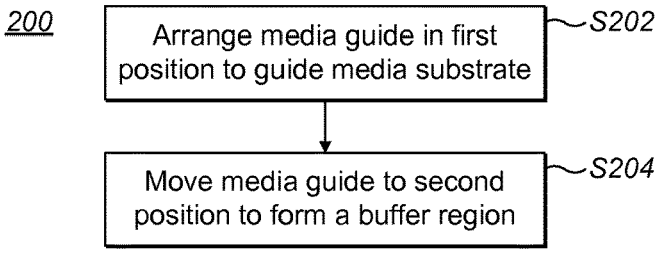
FIG. 2 is a flow diagram showing a method of operating a printing device according to an example.

FIG. 2 shows a method 200 of operating the printer 102 to form a buffer of substrate 106.

Figure 3A:
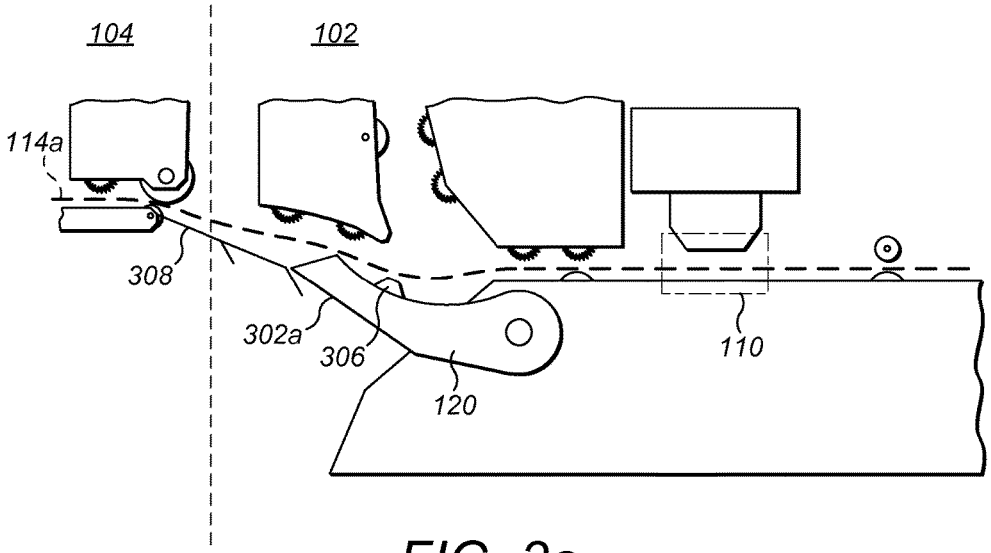
FIG. 3*a* is a schematic diagram of a printing system according to an example, in which a media guide is in a first position.
Figure 3B:
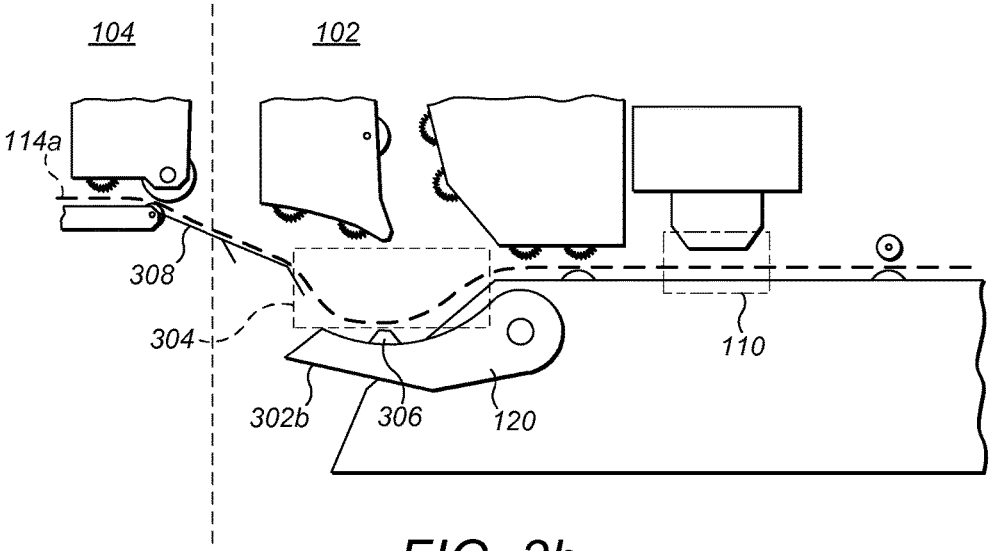
FIG. 3*b* is a schematic diagram of a printing system according to an example, in which a media guide is in a second position.

FIGS. 3*a* and 3*b* show the printing system 100 with the media guide 120 of the printer 102 in a first position 302*a* and a second position 302*b*.

At step S202, the media guide 120 is in the first position 302*a* in which it is arranged to guide the leading edge of the substrate 106 to one of the downstream media paths 114*a*, 114*b*, 114*c*. If the media guide 120 is already in the first position 302*a* it may remain there at step S202. If the media guide is not in the first position 302*a* it may be moved to the first position 302*a* at step S202. The first position 302*a* may be a position suitable to guide the substrate 106 to any one of the downstream media paths 114*a*, 114*b*, 114*c*.

At step S204, the media guide 120 is moved to the second position 302*b*. The second position 302*b* is spaced apart from the first position 302*a* to form a buffer region 304 into which an amount of media substrate 106 can collect.

The media guide 120 therefore performs both the function of guiding the substrate 106 to a desired downstream media path 114*a*, 114*b*, 114*c* and the function of creating the buffer region 304.

FIG. 3*a* schematically illustrates the media guide 120 in the first position 302*a*. In the illustrated example, the first position 302*a* is one in which the substrate 106 is to be guided from the printer 102 to the accessory device 104. When the media guide 120 of the printer 102 is in the first position 302*a*, the media guide 120 overlaps an interface 308 of the accessory device 104 (referred to hereinafter simply as the accessory interface 308).

FIG. 3*b* schematically illustrates the media guide 120 in the second position 302*b*, which is spaced apart (i.e. below) the first position 302*a*. As shown in FIG. 3*b*, with the media guide 120 in the second position 302*b* a buffer region 304 is created into which an amount of the substrate 106 can collect.

The substrate 106 is able to form a loop or curve within the buffer region 304, thereby effectively mechanically decoupling a portion of the substrate 106 in the print zone 110 from a portion of substrate 106 in the respective downstream media path 114*a*, 114*b*, 114*c*. This prevents forces directed towards or away from the downstream portion of the substrate 106 from pushing or pulling on the region of substrate 106 in the print zone 110.

Utilizing the media guide 120 to form the buffer region 304 enables buffering of substrate 106, and control of the buffered substrate 106, for multiple downstream media paths 114*a*, 114*b*, 114*c*. This results in a buffering solution that is less complex and less costly than existing solutions.

The media guide 120 depicted in FIGS. 3*a* and 3*b* includes, on an upper surface of the media guide 120, a sensor 306. The sensor 306 is arranged to detect the extent by which the substrate 106 forms a loop i.e. the amount of substrate 106 in the buffer region 304.

Providing the sensor 306 on the media guide 120 enables the use of a sensor 306 with a short detection range, or even a contact sensor. The sensor 306 can therefore be provided at relatively little expense.

The sensor 306 may be a non-contact sensor capable of sensing a distance between the media guide 120 and the substrate 106 in the buffer region 304. For example, the sensor 306 may be a photoelectric (optical) sensor, an ultrasonic sensor, or any other sensor suitable for detecting the substrate 106. The sensor 306 may be arranged to provide a signal to the printer 102 when the amount of substrate 106 in the buffer region 304 is at a minimum level and to provide another signal to the printer 102 when the amount of substrate 106 in the buffer region 304 is at a maximum level. Alternatively or additionally the sensor 306 may provide signals indicative of multiple positions of the substrate 106 between the maximum and minimum levels.

The amount of substrate 106 collected in the buffer region 304 may be controlled dynamically using feedback control in which the printer 102 provides a target speed to the accessory device 104 based on the signals provided by the sensor 306 that are indicative of the detected amount of substrate 106 in the buffer region 304.

In some examples, the second position 302*b* may be varied so as to keep the separation between the sensor 306 and the substrate 106 within the range of the sensor 306. In some examples, the printer 102 may be arranged to maintain a substantially constant separation between the sensor 306 and the substrate 106. The position of the media guide 120 may thereby be used to determine the amount of substrate 106 in the buffer region 304.

The sensor 306 may be an electro-mechanical contact sensor that provides a signal dependent on whether or not the sensor 306 is in contact with the substrate 106. The signal may be provided to the printer 102 (or to a processor used to control functions of the printer 102). The printer 102 may control the position of the media guide 120, and therefore the sensor 306, on the basis of the signal from the sensor 306. For example, where the sensor 306 provides a signal indicating that it is not in contact with the substrate 106, then the media guide 120 may be moved upwardly until the signal provided by the sensor 306 indicates that it is in contact with the substrate 106. Where the sensor 306 provides a signal indicating that it is in contact with the substrate 106, then the media guide 120 may be moved downwardly until the signal provided by the sensor 306 indicates that it is in not contact with the substrate 106. The printer 102 may thereby control the position of the media guide 120 dynamically such that its position follows a bottom of the loop of substrate 106.

The media guide 120 may include a positional encoder or some other means of determining its position. The position of the media guide 120 may thus be used to determine an amount of substrate 106 collected in the buffer region 304 for control of the amount of substrate 106 in the buffer region 304.

In some examples, the printer 102 may be arranged so that the sensor 306 is arranged to sense the non-printed side of the substrate 106. This enables reliable detection of the amount of substrate 106 collected in the buffer region 304 without marking or scratching the printed side of the substrate 106. Alternatively, the printer 102 may be arranged so that the sensor 306 is arranged to contact the printed side of the substrate 106.

The amount of substrate 106 that is to be collected in the buffer region 304 may be predefined for a range of print modes, printing speeds, and/or substrate type. For example, the predetermined amount of substrate 106 that is collected for a relatively stiffer substrate 106 may be greater than the predetermined amount for a relatively less stiff substrate 106.

The amount of substrate 106 in the buffer region 304 may be controlled by changing the relative speeds at which the printer 102 and/or the accessory device 104 advance the substrate 106. In an example, the speed at which the accessory device 104 advances the substrate 106 is controlled relative to the speed of the printer 102, to control the amount of substrate 106 collected in the buffer region 304. In particular, where the accessory device 104 is downstream of the printer 102, the speed at which the accessory device 104 advances the substrate 106 is decreased when more buffer is needed (i.e. when the buffer is close to being empty) and increased when less buffer is needed (i.e. when the buffer region 304 is close to being full).

Figure 4:
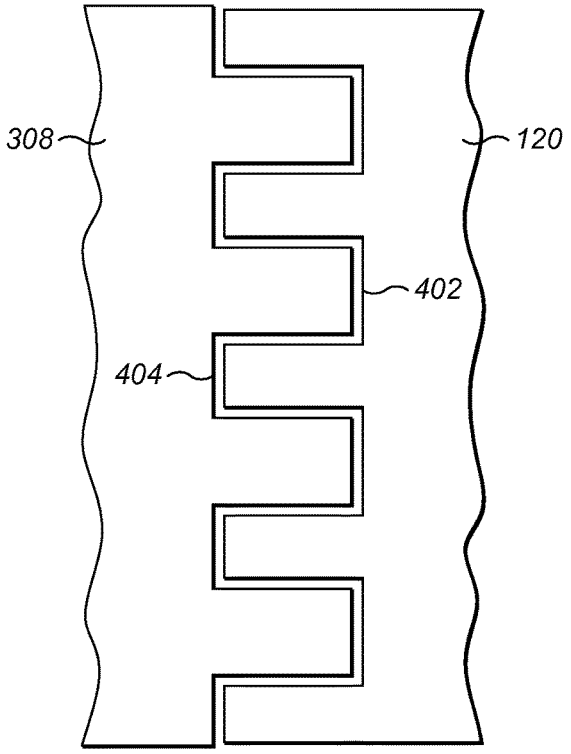
FIG. 4 is a schematic diagram of an interface between a printing device and an accessory device, viewed from above, according to an example.

FIG. 4 shows, in plan view, an example of how the media guide 120 and an accessory interface 308 can be arranged to enable the media guide 120 to move from the first position 302*a* to the second position 302*b* whilst being able to form an overlap with the accessory interface 308 when in the first position 302*a*.

In the illustrative example, an external edge 402 of the media guide 120 and an external edge 404 of the accessory interface 308 intermesh to form a substantially continuous surface, when the media guide 120 is in the first position 302*a*. In the particular example shown, each of the edges 402, 404 has a square-wave shape. However, it will be understood that the edges 402, 404 could have any shape suitable for enabling the edges 402, 404 to intermesh. This provides continuous support of the substrate 106 as it passes from the printer 102 to the accessory 104 and helps to avoid jams during the transfer.

As described above with reference to FIGS. 3*a* and 3*b*, the loop of substrate 106 that forms in the buffer region 304 loops downwardly so that the bottom of the loop can be detected by the sensor 306, and so that the substrate 106 does not contact a ceiling above the substrate 106 in the buffer region 304.

Figure 5:
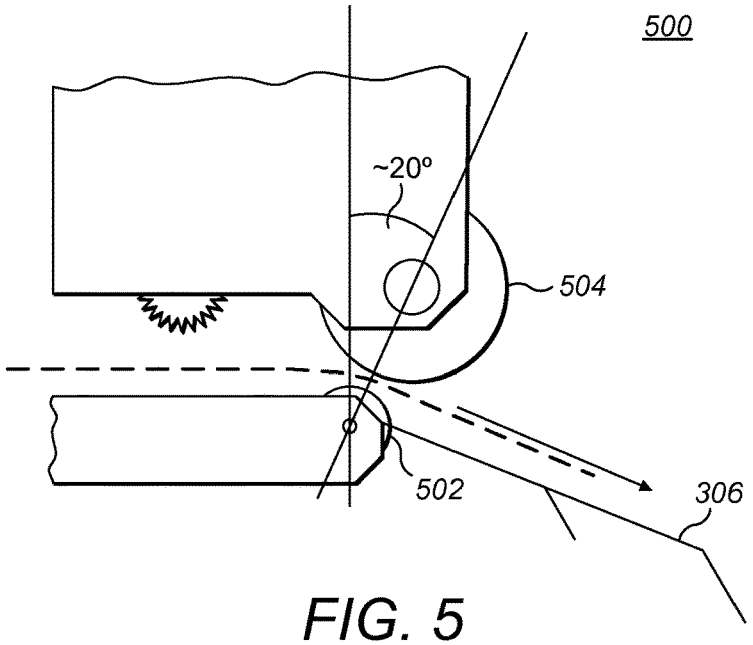
FIG. 5 is a schematic diagram of the accessory device of FIG. 1*a*, viewed from the side.

FIG. 5 illustrates an accessory device 500 arranged to improve the ability of the printing system 100 to ensure that the loop of substrate 106 forms downwardly.

The accessory device 500 comprises an input roller 502 and a pinch roller 504. The pinch roller 504 is separated from the input roller 502 by an amount sufficient to enable the substrate 106 to be guided between the input and pinch rollers 504, 502. An axis of rotation of the pinch roller 504, is vertically offset with respect to an axis of rotation of the input roller 502. In the illustrative example, the axis of rotation of the pinch roller 504, is vertically offset with respect to an axis of rotation of the input roller 502 by approximately 20° in a direction toward the printer 102.

When the speed at which the accessory device 104 advances the substrate 106 is less than the speed at which the printer 102 advances the substrate 106, the pinch roller 504 applies a friction force resisting the downstream flow of the substrate 106. The relative offset of the pinch roller 504 with respect to the input roller 502 creates a vertical component to the friction force (resistance), which is transmitted along the substrate 106 in an upstream direction and which pushes the substrate 106 in a downward direction.

Figure 6:
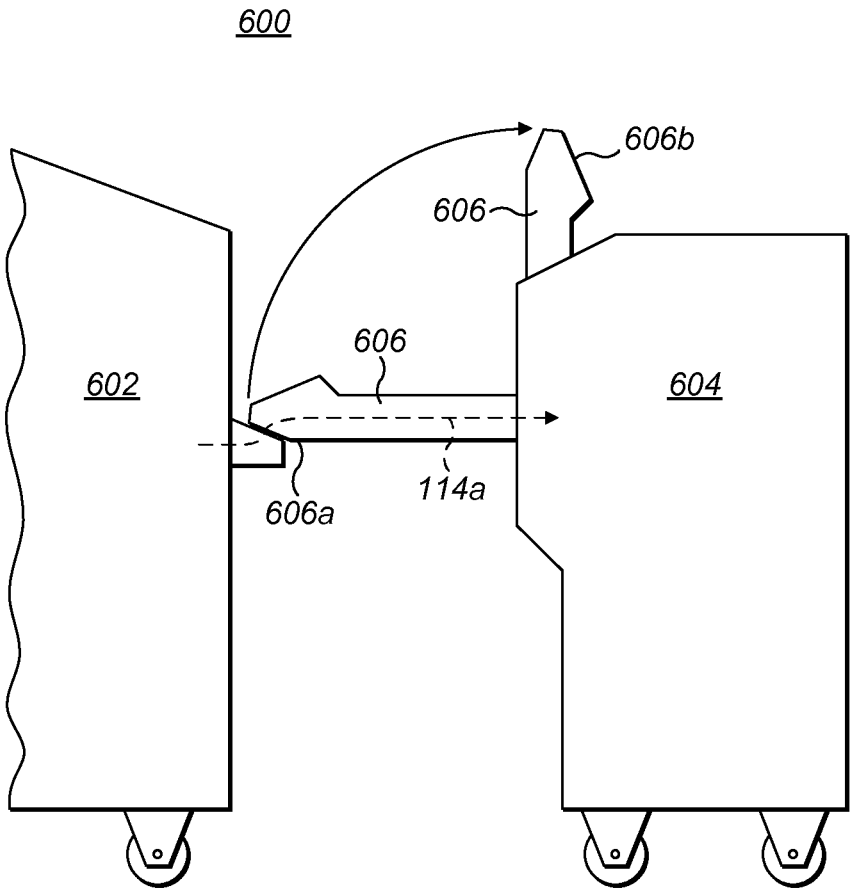
FIG. 6 is a schematic diagram of a printing system according to an example.

FIG. 6 shows an example of an arrangement of a printing system 600 in which a printer 602 is connectable to an accessory device 604 via a bridge arm 606. The bridge arm 606 is shown in two positions, a connected position 606*a* and a disconnected position 606*b*.

In the connected position 606*a* the bridge arm 606 forms the downstream media path 114*a*, along which the substrate is transported following transfer through the print zone 110 (not shown).

In order for the accessory interface 308 to intermesh with the media guide 120, the accessory interface 308 extends some way into the printer 102. Furthermore, as described above with reference to FIG. 4, to avoid jams, the accessory interface 308 is intermeshed with the media guide 120 of the printer 102. Therefore, in order for bridge arm 606 to move from the connected position 606*a* to the disconnected position 606*b*, the accessory interface 308 is arranged to be retracted when the bridge arm 606 is not in the connected position 606*a*.

Figure 7A:
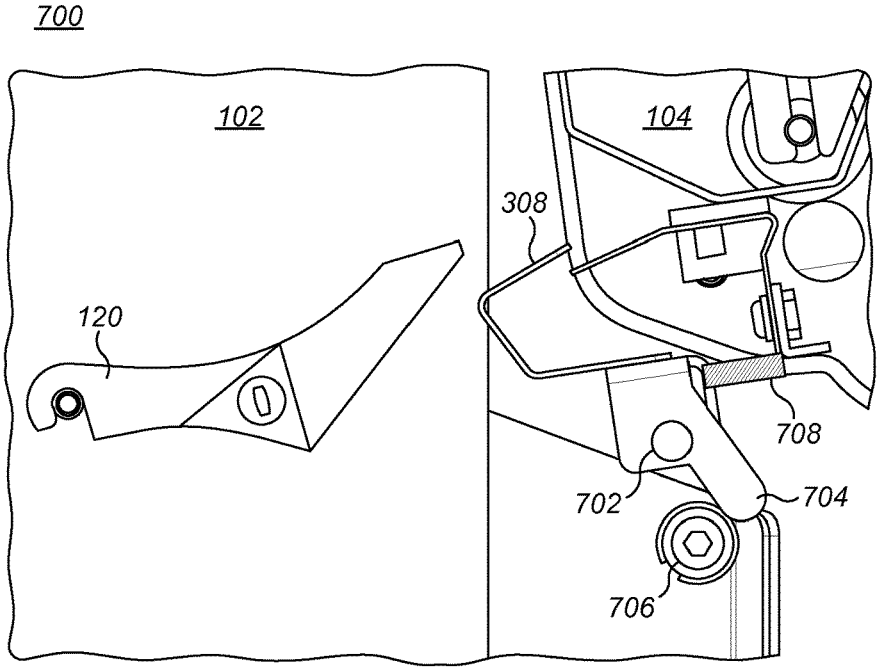
FIG. 7*a* is a schematic diagram of an interface between a printing device and an accessory device, viewed from the side, according to an example.
Figure 7B:
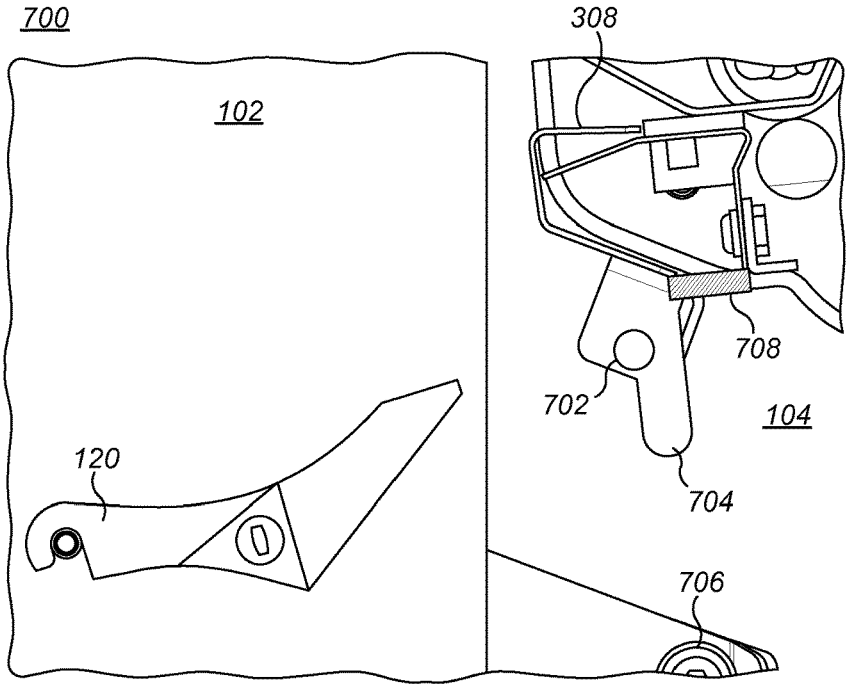
FIG. 7*b* is a schematic diagram of an interface between a printing device and an accessory device, viewed from the side, according to an example.

FIGS. 7*a* and 7*b* show an example of a retraction mechanism 700 for retracting the accessory interface 308.

The accessory interface 308 is connected to the accessory device 104 by a pivot 702. Arranged at an opposite side of the pivot 702 to the accessory interface 308 is a lever arm 704. The lever arm 704 is arranged to engage a reference datum 706 located on the printer 102. The mechanism 700 includes a biasing spring 708 that is arranged to pull the accessory interface 308 into the accessory device 104 (specifically into the bridge arm 606).

FIG. 7*a* shows the position of the mechanism 700 when no force is applied to the lever arm 704 i.e. when the bridge arm 606 is in the disconnected position 606*b*. The accessory interface 308 is retracted to within the accessory device 104 by the biasing force of the spring 708. This enables the bridge arm 606 to be moved from the disconnected position 606*b* to the connected position 606*a* (and the reverse operation), without the accessory interface 308 coming into contact with the printer 102.

FIG. 7*b* shows the mechanism 700 when the bridge arm 606 is moved to the connected position 606*a*. In this position, the reference datum 706 engages the lever arm 704 to apply a force countering the biasing force of the spring 708. The resulting force causes the mechanism 700 to rotate about the pivot 702 in turn causing the accessory interface 308 to extend from the accessory device 104 and protrude into the printer 102. This enables the accessory interface 308 to intermesh with the media guide 120 when the bridge arm 606 is in the connected position 606*a*. This illustrative mechanism 700 therefore provides an easy method of attaching and detaching the accessory device 104 to/from the printer 102 that is also robust against jams.

The above arrangements are to be understood as illustrative examples. Further arrangements and modifications to those arrangements are envisaged. For example, although the examples described above are described with reference to an accessory device located on the downstream media path, it will be understood that with an appropriately located media guide, the buffer region could be formed in the upstream media path.

Such an upstream accessory device may perform one or more functions before the printer 102 has printed to the substrate 106. For example, an upstream accessory device may be a high-capacity input tray, a roll unwinding device, a substrate primer, or another printer.

Although the above examples are described with reference to a page-wide array printer, it will be understood that the principles could equally be applied to other printers, such as scanning printers and offset printers.

It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

What is claimed is:

1. A printing device comprising:

a media guide arranged to guide a printable media substrate from an upstream media path towards an input of the printing device or away from an output of the printing device towards a downstream media path, the media guide being movable between:

a first position, arranged to guide the printable media substrate along a respective media path; and a second position that is spaced apart from the first position to form a buffer region into which a variable amount of printable media substrate can collect; and a sensor arranged to detect an amount of media substrate collected in the buffer region and to provide a signal indicative of the detected amount to the printing device.

2. The printing device according to claim 1, wherein the second position is variable to vary the size of the buffer region.

3. The printing device according to claim 1, wherein the sensor is disposed on the media guide.

4. The printing device according to claim 1, arranged to control the amount of media substrate collected in the buffer region on the basis of the detected amount.

5. The printing device according to claim 1, arranged to control a media feed rate of an accessory device relative to a media feed rate of the printing device on the basis of the detected amount.

6. The printing device according to claim 5, arranged to provide a control signal indicative of the media feed rate at which the accessory device is to operate.

7. The printing device according to claim 5, arranged to provide a first control signal to decrease the media feed rate of the accessory device when the detected amount is below a first threshold, and to provide a second control signal to increase the media feed rate of the accessory device when the detected amount is above a second threshold.

8. The printing device according to claim 1, wherein the second position is varied on the basis of the detected amount.

9. The printing device according to claim 1, wherein the printing device comprises multiple downstream media paths and, in the first position, the media guide is arranged to guide the printable media substrate along one of the multiple downstream media paths.

10. The printing device according to claim 1, wherein the variable amount of media substrate can collect below a respective media path.

11. The printing system comprising an accessory device and a printing device according to claim 1.

12. The printing system according to claim 11, wherein the accessory device comprises a retractable interface arranged to engage with an output of the printing device.

13. The printing system according to claim 12, wherein the retractable interface is movable between:

a first position, in which the retractable interface extends from the accessory device to engage with the media guide of the printing device; and a second position, in which the retractable interface retracts to a retracted position within the accessory device.

14. The printing system according to claim 12, wherein the media guide of the printing device and the retractable interface of the accessory device intermesh.

15. A method of operating a printing device comprising a movable media guide, the method comprising:

arranging the media guide in a first position arranged to guide a printable media substrate from an upstream media path towards an input of the printing device or away from an output of the printing device towards a downstream media path;

moving the media guide to a second position that is spaced apart from the first position to form a buffer region into which a variable amount of media substrate can collect;

detecting an amount of media substrate collected in the buffer region via a sensor; and providing a signal indicative of the detected amount to the printing device.

* * * * *